US012207708B2

(12) United States Patent
Macri'

(10) Patent No.: US 12,207,708 B2
(45) Date of Patent: Jan. 28, 2025

(54) ZIP WITH PIVOTING COUPLING ELEMENTS

(71) Applicant: Giacomo Macri', Turin (IT)

(72) Inventor: Giacomo Macri', Turin (IT)

( * ) Notice: Subject to any disclaimer, the term of this patent is extended or adjusted under 35 U.S.C. 154(b) by 86 days.

(21) Appl. No.: 18/018,995

(22) PCT Filed: Jul. 27, 2021

(86) PCT No.: PCT/EP2021/071014

§ 371 (c)(1),
(2) Date: Jan. 31, 2023

(87) PCT Pub. No.: WO2022/028953

PCT Pub. Date: Feb. 10, 2022

(65) Prior Publication Data

US 2023/0292887 A1 Sep. 21, 2023

(30) Foreign Application Priority Data

Aug. 4, 2020 (IT) ..... 102020000018994

(51) Int. Cl.
*A44B 19/02* (2006.01)
*A44B 19/06* (2006.01)

(52) U.S. Cl.
CPC ..... *A44B 19/06* (2013.01)

(58) Field of Classification Search
CPC ..... A44B 19/06
See application file for complete search history.

(56) References Cited

U.S. PATENT DOCUMENTS 2,170,421 A * 8/1939 Morin ..... A44B 19/06 24/406
2,193,870 A * 3/1940 Gross ..... A44B 19/04 24/411
2,335,668 A * 11/1943 Hamm ..... A44B 19/06 24/411
2,353,106 A * 7/1944 Winterhalter ..... A44B 19/06 24/414
2,371,591 A * 3/1945 Cizek ..... A44B 19/04 24/410
2,380,623 A * 7/1945 Winterhalter ..... A44B 19/403 24/414

(Continued)

OTHER PUBLICATIONS

Jennifer D'Souza, International Search Report and Written Opinion, European Patent Office, PCT/EP2021/071014, Nov. 3, 2021.

*Primary Examiner* — Jason W San
(74) *Attorney, Agent, or Firm* — Gavrilovich, Dodd & Lindsey LLP

(57) ABSTRACT

The present invention describes a zip comprising a pair of webbings (29; 38), each of which has in its side edges sequences of coupling elements or teeth (5; 12) facing with respect to their sector of joining with the webbing, each of these coupling elements (5; 12), being able to pivot around its central vertical axis thanks to a support placed between the coupling element (5; 12) and the webbing (29; 38), wherein the coupling element (5; 12) engages with the support and the latter with the webbing (29; 38), characterised in that said support consists of a cylinder (30) or of two half-cylinders (18, 19) placed in a specular manner at the opposite sides of the webbing (29).

13 Claims, 14 Drawing Sheets

(56) References Cited

U.S. PATENT DOCUMENTS 2,397,331 A * 3/1946 Winterhalter ..... A44B 19/06 24/413
2,440,007 A * 4/1948 Frank ..... A44B 19/06 24/410
2,491,197 A * 12/1949 Morin ..... A44B 19/04 24/411
2,517,402 A * 8/1950 Morin ..... A44B 19/08 24/409
2,727,290 A * 12/1955 Campburi Planas .. A44B 19/06 24/414
2,748,439 A * 6/1956 Owen ..... A44B 19/04 24/429
2,828,523 A * 4/1958 Morin ..... A44B 19/04 24/406
2,867,879 A * 1/1959 Urban ..... A44B 19/02 24/411
3,178,788 A * 4/1965 Johns ..... A44B 19/06 24/414
3,302,259 A * 2/1967 Waldes ..... A44B 19/06 24/411
3,508,304 A * 4/1970 Burbank ..... A44B 19/06 24/421
4,651,388 A * 3/1987 Horikawa ..... A44B 19/06 24/409
5,394,593 A * 3/1995 Aoki ..... A44B 19/06 24/409
2005/0183246 A1* 8/2005 Ozaki ..... B21D 53/52 24/403
2006/0260104 A1* 11/2006 Himi ..... A44B 19/06 24/403
2008/0313867 A1* 12/2008 Morioka ..... A44B 19/06 24/403
2009/0113676 A1* 5/2009 Chung ..... A44B 19/06 24/406
2011/0010899 A1* 1/2011 Kozato ..... A44B 19/06 24/409
2012/0036685 A1* 2/2012 Wang ..... A44B 19/06 24/399
2015/0313322 A1* 11/2015 Lu ..... A44B 19/08 24/414
2016/0015133 A1* 1/2016 Chung ..... A44B 19/06 24/411
2016/0183640 A1* 6/2016 Chung ..... A44B 19/06 24/406
2017/0251772 A1* 9/2017 Yamamoto ..... A44C 27/006
2018/0213894 A1* 8/2018 Natsuaki ..... A44B 19/26
2019/0216183 A1* 7/2019 Takani ..... A44B 19/02
2023/0068548 A1* 3/2023 Hiromi ..... A44B 19/403
2023/0292887 A1* 9/2023 Macri' ..... A44B 19/06 24/413

* cited by examiner

ZIP WITH PIVOTING COUPLING ELEMENTS

CROSS REFERENCE TO RELATED APPLICATIONS

This application is a U.S. National Phase application filed under 35 U.S.C. § 371 and claims priority to International Application No. PCT/EP2021/071014, filed Jul. 27, 2021, which application claim priority to Italian Application No. 102020000018994, filed Aug. 4, 2020, the disclosure of which are incorporated herein by reference.

DESCRIPTION

Field of the Art

The present invention relates to a flexible zip, which can be used to open and close a variety of articles, such as, merely by way of a non-limiting example, suitcases, bags, clothing and footwear.

More particularly, the present invention relates to a zip provided with pivoting teeth, i.e., capable of rotating on themselves in such a way as to allow the zip to follow the curvature of the opening/closing line required by the article.

The rotation of the teeth makes it possible to optimise the functionality of the zip, above all in the presence of a curved slot with a very small radius of curvature.

Background of the Invention

As is known, a zip is made up, inter alia, of the following three elements:

webbing;

teeth;

slider with tab.

Specifically, the zip is composed of a pair of webbings arranged in a flat position. The two webbings, generally made of fabric, are characterised in that they have a series of coupling elements called teeth along their inner edge. The teeth are fixed and anchored to the webbing in an equidistant and parallel manner one in relation to the other.

Referring to FIGS. 1 to 4 of the accompanying drawings, said coupling elements have the typical U-shaped frontal shape and, in detail, the following can be distinguished:

a connection end 1, the so-called head;

an anchorage end 2, in the part wherein the tooth goes to hook onto the webbing;

an intermediate portion 3, 4, interposed between the two preceding ones, which by extending defines the internal groove of the tooth.

The legs of the tooth, formed by the intermediate portion and by the anchoring end, attach and clamp onto the webbing. Specifically, the edge of the webbing is positioned in the groove of the tooth, to which the leg members are then clamped.

The webbings with the coupling elements are called tapes.

The slider is the sliding part of the zip which allows opening and/or closure thereof by forcing the reciprocal interlocking of the teeth anchored on the two webbings. Said slider is composed of two plates parallel one to the other separated by a wedge which forms a Y-shaped gap in which the series of teeth of the webbings slide in one and in the other track. The wedge forms, in fact, a path with such an angle as to allow the teeth to interlock or open during the sliding of the slider in one direction or in the other. By dragging the slider in one direction along the tapes the coupling elements are forced to interlock one with the other, while by dragging it in the other direction the latter separate. The tapes hooked one to the other by the action of the slider form the chain.

In the current state of the art, the zip is primarily manufactured on the plane of the webbing with a linear layout.

This means that the majority of zips known to the present state of the art are able to allow the opening and the closure of the slot of an article only when the latter is configured as a straight-line segment and lying in the same plane as the webbing.

Often, however, the slots present in many articles require a curved zip, where the straight-line segment moves on a variable plane with respect to that of the webbing, as is the case, for example, in suitcases, in bags or in clothing.

For this reason, the problem of the curvature of the zip has already arisen for professionals in the sector, who have reached various solutions.

However, the techniques they have put forward have mainly affected the ability of the webbing to follow the curvature of the required opening/closing line, instead maintaining the mechanism of anchoring and interlocking of the teeth to the same unaltered.

The curvature of the zip is in fact essentially permitted by the ability of the webbing to contract or expand, so that the teeth, anchored thereto in a fixed manner, consequently follow the expansion of the webbing to which they are, in fact, immovably secured.

On the other hand, other techniques have focused attention on the tooth, creating for this purpose particular types, with special interlocking mechanisms and relative sliding sliders (see, for example, EP2705768).

The solutions put forward do, however, have limitations and disadvantages.

In both cases, in fact, the radius of curvature cannot be small in size.

This is because with a smaller radius of curvature of the slot, the greater the excess of fabric that will be created in the concave fold of the webbing, forming unsightly creases and wrinkles. In the convex part there will be the opposite problem of lack of fabric which, due to its stiffness, will not be able to permit an extension of the webbing.

Such a problem has been solved by some by producing upstream webbings with curvature lines that adapt perfectly to the slot by means of cuts on their edges, thus allowing, on the one hand, the elimination of the excess fabric and, on the other hand, greater expansion and dilation of the same.

The limitation of this solution lies in the fact that the zip must necessarily be produced with the radius of curvature originally requested by the user and cannot be adapted to other slots.

In technical solutions involving the configuration of the tooth, the extent of the radius of curvature is further limited by the shape of the tooth itself. In fact, in light of the precarious system of reciprocal interlocking between the teeth, the latter will not be able to move to a great extent, otherwise the zip itself will not hold.

Secondly, although the zips known at the present state of the art can be used in both horizontal and vertical positions, their functioning is articulated only on the plane of the webbing itself. Similarly, the plane of the webbing will be the only one in which the possible line of curvature of the zip permitted by the aforementioned techniques can be found.

Specifically, the teeth, being immovably fixed to the webbing, merely undergo the curvature of the webbing itself, giving an illusory sense of movement. In actual fact, the teeth remain immobile, clamped to the webbing, and it is only the latter which, by curving, causes them to move away one from the other following the radius of the curvature itself, with a movement that is properly V-shaped.

The aforesaid solutions do not, however, address the problem of the curvature of the zip when the plane of the slot is curved. By way of an example, the corners of wheeled luggage or similar articles are considered.

In these cases, in order to make the zip resistant, the dimensions of the mesh of the tooth are necessarily larger, with the consequence that they are unsightly. In addition, the action of the slider is hindered and slowed down by the friction created by the teeth placed at the curve. This occurs in that the teeth are static on the webbing.

U.S. Pat. No. 2,193,870 describes a zip formed by a series of teeth having a recess on one side and on the other side a freely rotatable spherical element. The spherical element of one tooth couples with the recess of an adjacent tooth, thus forming a zip that can be used on a surface with a certain curvature. However, this solution is also inconvenient in that it requires a predefined configuration in which the teeth are necessarily at a very close distance one in relation to the other.

SUMMARY OF THE INVENTION

The object of the invention is therefore to provide a zip capable of overcoming the disadvantages disclosed above.

More particularly, it is an object of the present invention to provide a zip with teeth capable of rotating on themselves so as to allow the zip to follow specific curvatures of the opening/closing line required by the article whereto they are applied.

These and other objects are achieved by a zip with pivoting joining elements according to the invention having the features listed in the appended independent claim 1.

Advantageous embodiments of the invention are disclosed by the dependent claims.

Substantially, the present invention describes a zip comprising a pair of webbings, each of which has in its side edges sequences of coupling elements or teeth facing their sector of joining with the webbing, each of these coupling elements being able to pivot around its central vertical axis thanks to a support placed between the coupling element and the webbing, wherein the coupling element engages with the support and the latter with the webbing and wherein said support consists of a cylinder or two half-cylinders in a specular manner arranged on opposite sides of the webbing.

The inventive scope of the present invention, in addition to those which will be described in greater detail below, consists in having created a zip capable of closing in an optimal manner any type of slot in an article lying also on different planes.

This is made possible by an intelligent pivoting tooth, i.e. one that is capable of rotating on itself around its central vertical axis, so that the movement is transverse with respect to the plane of the webbing.

Specifically, the inventive scope of the present invention relates only to the tooth, maintaining unchanged—with respect to the zips currently on the market-both the webbings, which can be made of fabric or also any other type of material, and the slider with its known mechanism of functioning.

The ability of this zip to follow the curvature of the slot present in the article-which may have a very small radius-therefore no longer originates in the contraction/dilation of the webbing, which remains unchanged, or in the construction of special teeth which interlock one with the other by means of the action of a particular slider, but instead in the rotation of each tooth which will naturally go to follow the required curvature line, when and if required.

The aforesaid circumstances make the present invention extremely functional and ductile, given that it can be used on any article, irrespective of the type of opening/closure required.

The zip that forms the subject of the present invention can be used to close only linear, only curved or mixed slots, i.e. both linear and curved. In fact, the autonomous and independent mobility of each tooth makes the latter rotate on itself only when necessary, that is, only should the line of closure of the product need a curvature.

Also in the latter case, unlike the zips currently on the market, the sliding of the slider on the zip chain is smooth and the slider slides without jamming or snagging. The zip is also more resistant and more pleasing aesthetically.

Merely by way of example, consideration can be made of the bag and/or luggage product sector. Such articles all have zips with very large teeth and difficulties in closing in the curvatures imposed by the article itself, above all in travel bags, wheeled luggage, etc.

The inventive scope of the present invention is easily understood by those working in the sector. The zip that forms the subject of the present invention is in fact able to naturally follow the curvature of the articles, being able to be extremely resistant even with smaller mesh teeth.

Furthermore, the rotation of the tooth avoids the creation of unsightly wrinkles or irregularities on the surface of the webbing, a disadvantage which can currently occur when the line of the webbing does not perfectly match the line of the slot.

Moreover, the present invention is found to be extremely functional in another respect.

Given that no further particular techniques are required, it can be easily adapted to commercially available webbings or to common zip sliders and easily manufactured.

The latter may be conveniently used with the present invention in light of the fact that the configuration of the zip has not been modified in its main elements of functioning.

In particular, the mechanism of sliding of the slider on the chain of teeth has not been altered, nor has the typical configuration of the latter functional to their reciprocal interlocking been changed.

As is in fact clear, the head of the tooth, functional to the system of reciprocal interlocking between the teeth, is unchanged with respect to today's commercially available zips (no. 1 FIG. 1; no. 5 FIG. 5 and no. 12 FIG. 9).

Specifically, the inventive scope of the present invention concerns the two legs of the tooth (nos. 6 and 7 FIGS. 5 and 13 and 14 FIG. 9) and the mechanism of anchoring of the latter to the webbing (FIG. 14 and FIG. 29).

In fact, the tooth no longer hooks directly onto the webbing but instead goes to interlock with particular supports that are, instead, in fact, directly fixed to the fabric.

BRIEF DESCRIPTION OF THE DRAWINGS

Further features of the invention will be made clearer by the following detailed description, referring to its purely illustrative, and therefore non-limiting, embodiments illustrated in the accompanying drawings, in which.

DESCRIPTION OF PREFERRED EMBODIMENTS

Figure 1:
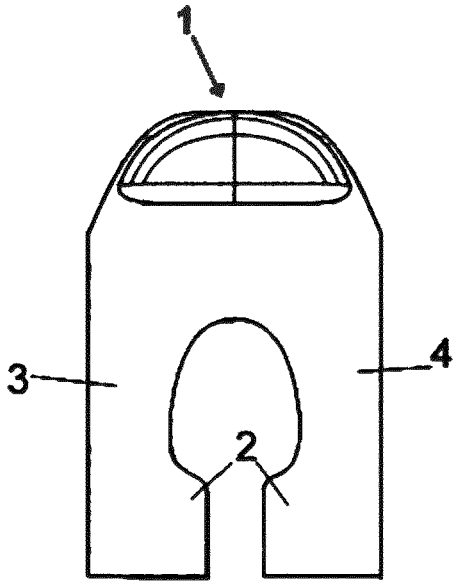
FIG. 1 represents a front view of a tooth of the prior art.
Figure 2:
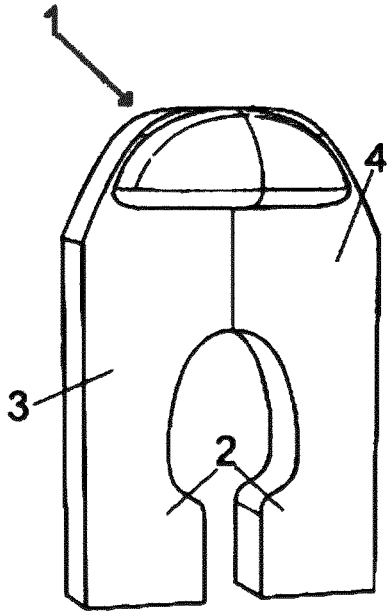
FIG. 2 represents a front perspective view of a tooth of the prior art.
Figure 3:
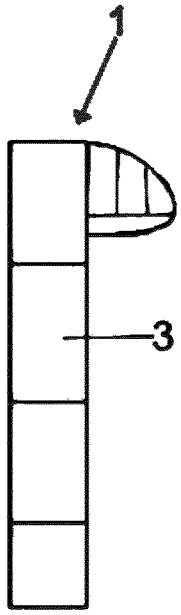
FIG. 3 represents a side view of a tooth of the prior art.
Figure 4:
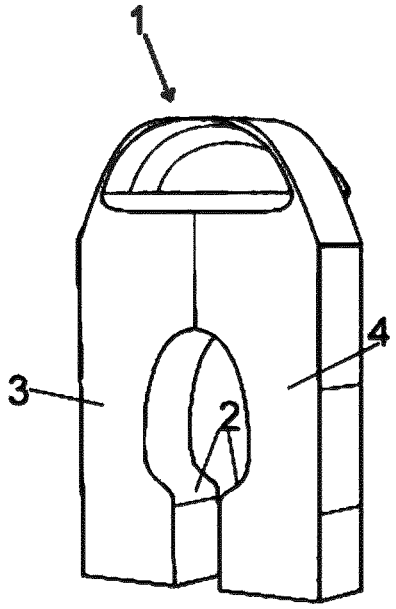
FIG. 4 represents a rear perspective view of a tooth of the prior art.
Figure 5:
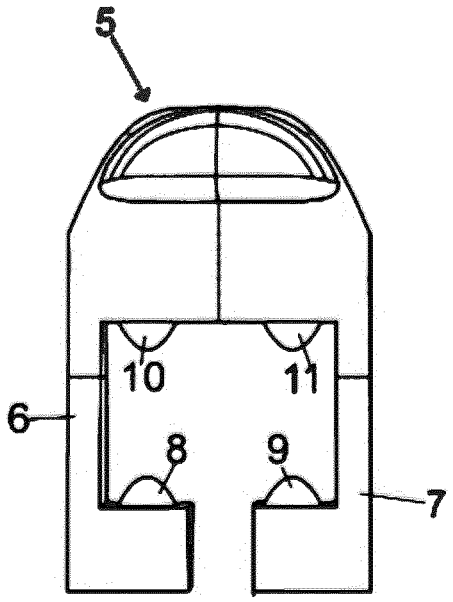
FIG. 5 represents a front perspective view of a tooth in accordance with the first embodiment.
Figure 6:
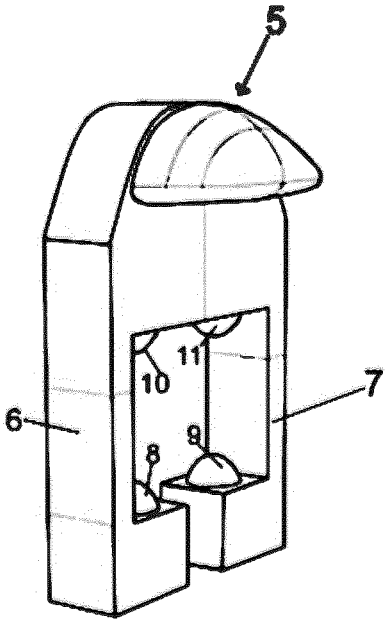
FIG. 6 represents a front perspective view of a tooth in accordance with the first embodiment.
Figure 7:
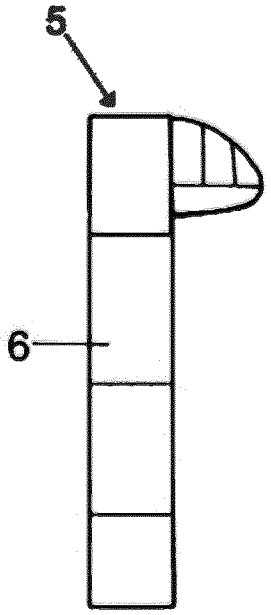
FIG. 7 represents a side view of a tooth in accordance with the first embodiment.
Figure 8:
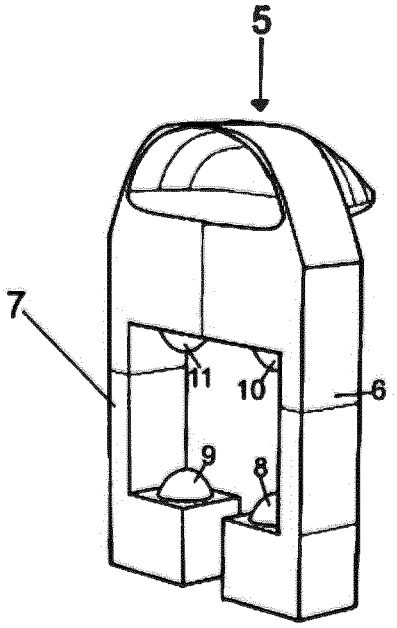
FIG. 8 represents a rear perspective view of a tooth in accordance with the first embodiment.
Figure 9:
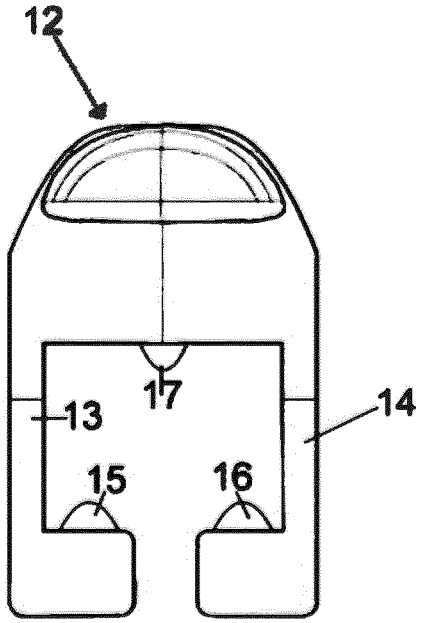
FIG. 9 represents a front view of a tooth in accordance with the second embodiment.
Figure 10:
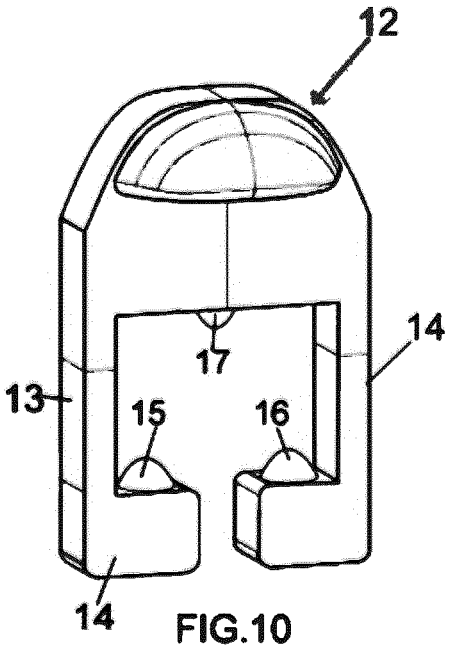
FIG. 10 represents a front perspective view of a tooth in accordance with the second embodiment.
Figure 11:
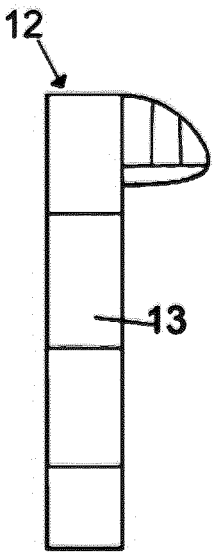
FIG. 11 represents a side view of a tooth in accordance with the second embodiment.
Figure 12:
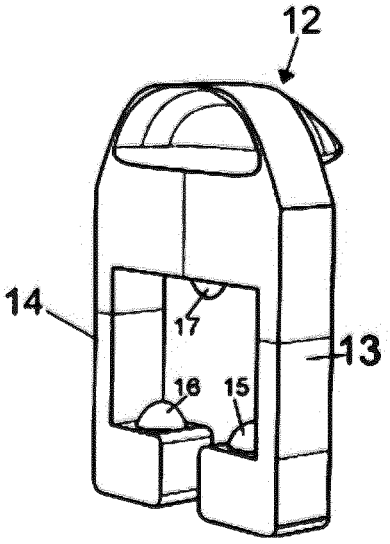
FIG. 12 represents a rear perspective view of a tooth in accordance with the second embodiment.

The present invention is described according to two possible modes of implementation, in any case not limiting of its embodiments.

The present invention can in fact undergo variations in execution/implementation within the scope of the invention described above. As clearly indicated above, the core of the present invention concerns the ability of the tooth to pivot around its central vertical axis. This movement is permitted by a particular support, placed between the tooth and the webbing, whose conformation is such as to allow the rotation of the tooth.

First Embodiment

According to the first embodiment of the present invention, represented in FIGS. 5 to 8 and 13 to 27, a coupling element or tooth 5 goes to insert in a particular support, constituted by two half-cylinders 18 and 19 provided with a respective hole 27 and 28 which traverses them from side to side.

Each half-cylinder 18, 19 is positioned on the opposite faces of a webbing 29 in such a way as to have their vertical section 25 and 26 adjacent to the strip of fabric.

The two half-cylinders 18 and 19 are then joined one to the other and to the webbing 29 by means of a pin 24 which traverses them by passing through their holes 27 and 28 and perforating, in the middle, the webbing itself 29. In this way, the half-cylinders 18 and 19 are firmly anchored to the fabric and bound one to the other creating a "small cylinder".

Figure 24:
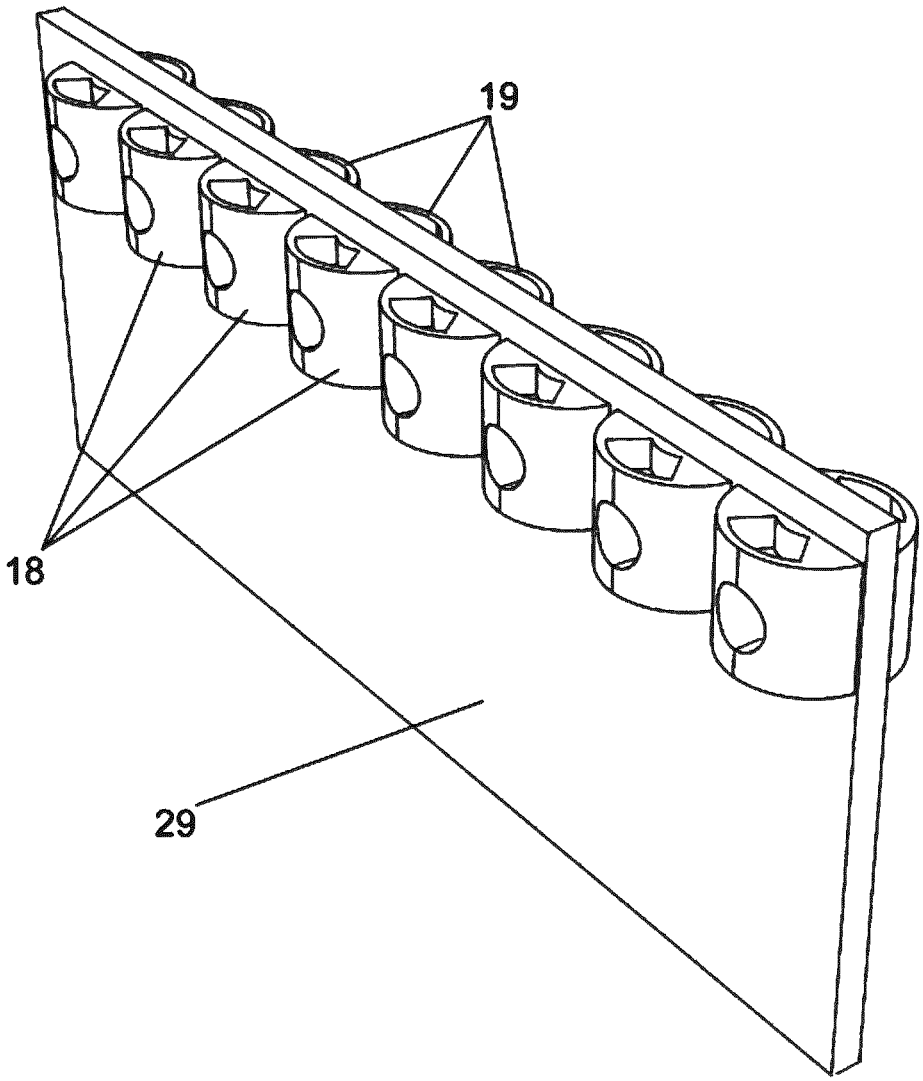
FIG. 24 represents a perspective view of the webbing with a series of supports of the tooth punched into the fabric in accordance with the first embodiment.

These cylinders form the fixed point on the webbing of the zip forming the subject of the present invention and can be mounted equidistant, or not, from each other on the webbing 29 (FIG. 24).

The two half-cylinders are finally provided with two pairs of identical tracks 20, 21 and 22, 23 positioned on their horizontal planes, or upper and lower faces, perpendicular to the longitudinal plane of the half-cylinders.

The tooth 5 shown in the various drawings, is characterised in that it has two legs 6 and 7 in the shape of an "L".

In its inner central part there are four protrusions 8, 9, 10, 11 depicted, by way of a non-limiting example, in an ovoid shape.

More particularly, two of these protrusions 8 and 9 are positioned in the horizontal part of the "L" of the legs of the tooth. The other two protrusions 10 and 11 are positioned in a specular manner in front of these, under the head of the tooth.

Each of the aforementioned protrusions is mainly designed to fit into the respective track of the abovementioned half-cylinder.

More particularly, the lower protrusions 8 and 9 are inserted in the lower tracks 22 and 23, while the upper protrusions 10 and 11 are inserted in the upper tracks 20 and 21.

Figure 15:
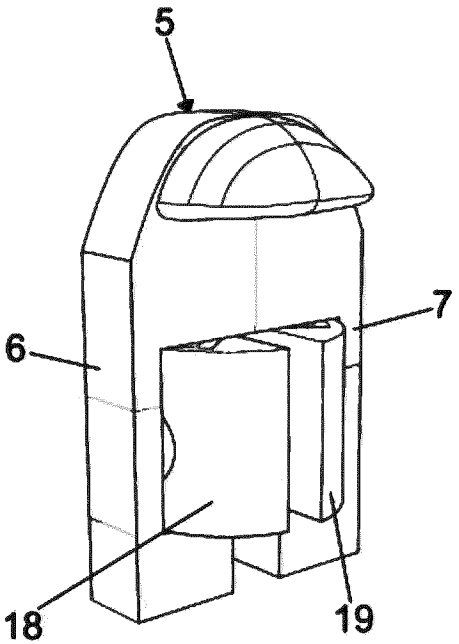
FIG. 15 represents a complete perspective view of a tooth that is the subject of the present invention in accordance with the first embodiment.
Figure 14:
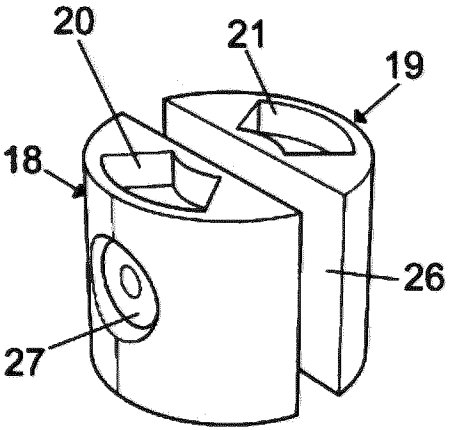
FIG. 14 represents a perspective view of the support of a tooth in accordance with the first embodiment.
Figure 13:
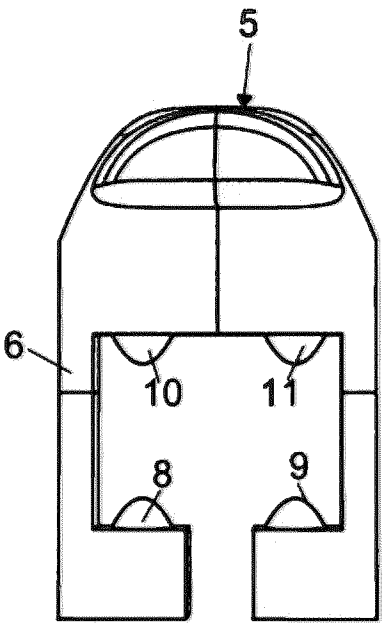
FIG. 13 represents a front view of a tooth in accordance with the first embodiment.
Figure 16:
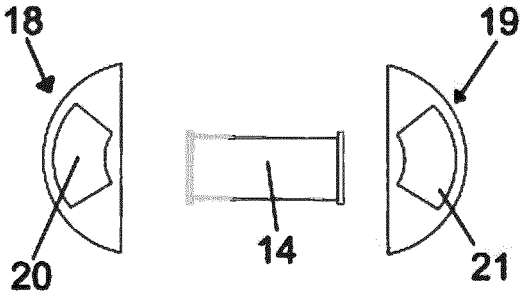
FIG. 16 represents a view from above of the support of a tooth with the pin in accordance with the first embodiment.
Figure 17:
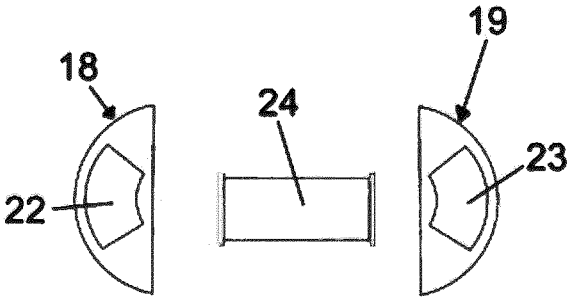
FIG. 17 represents a view from a below of the support of a tooth with the pin in accordance with the first embodiment.
Figure 18:
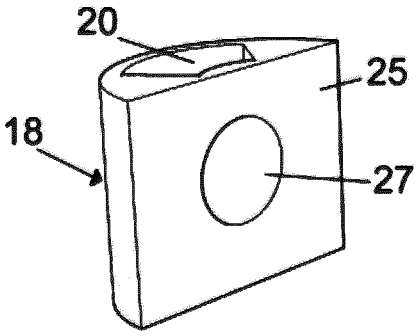
FIG. 18 represents an internal perspective view of the first half-cylinder of the support of a tooth in accordance with the first embodiment.
Figure 19:
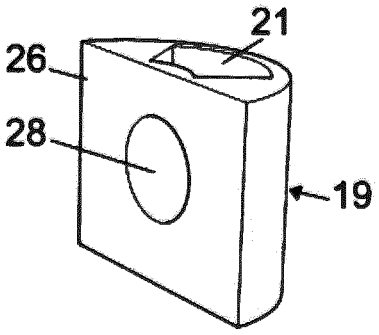
FIG. 19 represents an internal perspective view of the second half-cylinder of the support of a tooth in accordance with the first embodiment.
Figure 20:
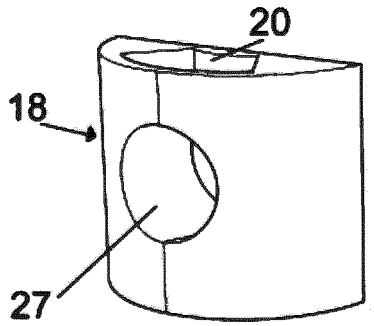
FIG. 20 represents an external perspective view of the first half-cylinder of the support of a tooth in accordance with the first embodiment.
Figure 21:
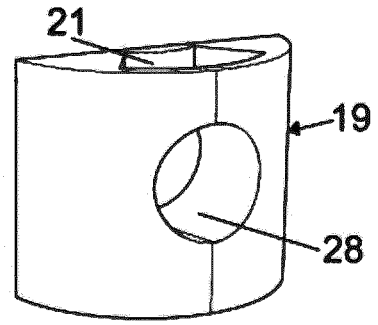
FIG. 21 represents an external perspective view of the second half-cylinder of the support of a tooth in accordance with the first embodiment.
Figure 22:
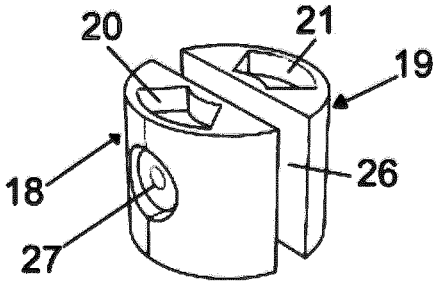
FIG. 22 represents a perspective view of the support of a tooth in accordance with the first embodiment.
Figure 23:
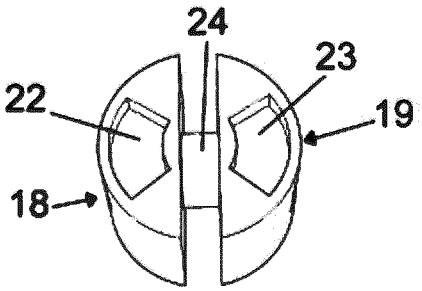
FIG. 23 represents an upper perspective view of the support of a tooth in accordance with the first embodiment.

The final complete configuration of the tooth 5 coupled to the relative support forming the subject of the present invention is shown in FIG. 15.

Figure 25:
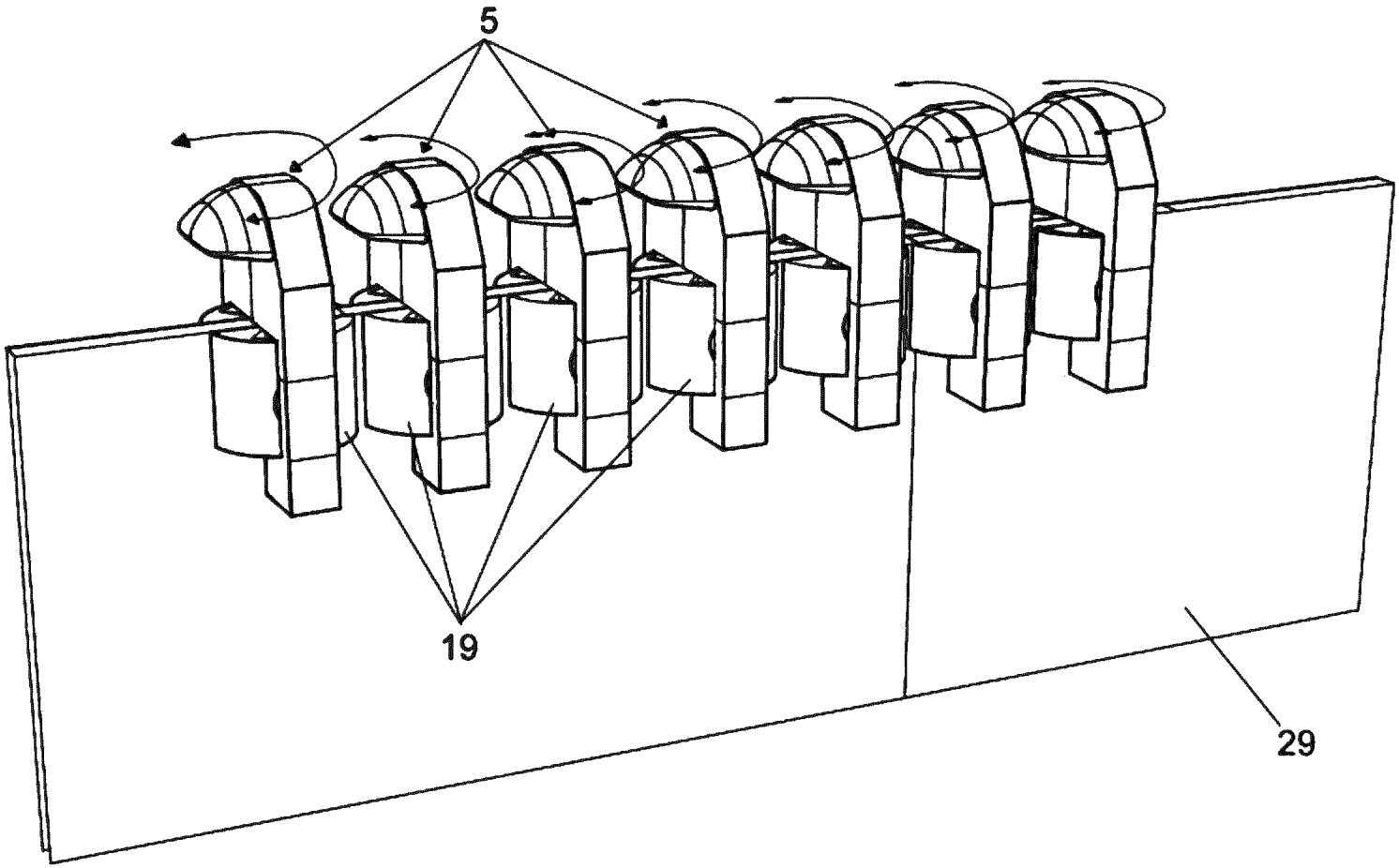
FIG. 25 represents a longitudinal view of the tape with a series of teeth forming the subject of the present invention in accordance with the first embodiment.

The rotation mechanism of the tooth 5 is intuitive: its protrusions slide, in one direction or in the other, along the tracks of the two half-cylinders 18 and 19 and the rotation is therefore axial around the vertical central axis of the tooth. FIG. 25 is a schematic representation of a series of teeth 5 applied to a fabric webbing 29 by means of the supports formed by the half-cylinders 18 and 19.

The subject of the present invention has, therefore, a fixed part stably punched to the webbing, i.e. the two half-cylinders 18 and 19, and a movable and pivoting part, i.e. the tooth 5 proper, which oscillates thanks to the sliding of the protrusions 8, 9, 10, 11 along the tracks 20, 21, 22, 23 of the half-cylinders 18 and 19.

Figure 26:
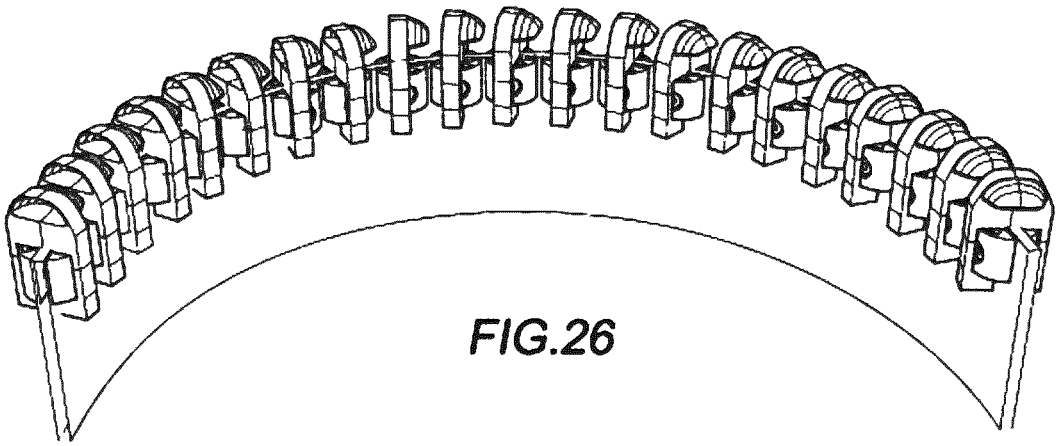
FIG. 26 represents a longitudinal perspective view of the tape with a series of teeth forming the subject of the present invention in accordance with the first embodiment.

The chain of the zip forming the subject of the present invention is therefore constituted by a series of teeth with relative supports as above described (FIG. 26).

Figure 27:
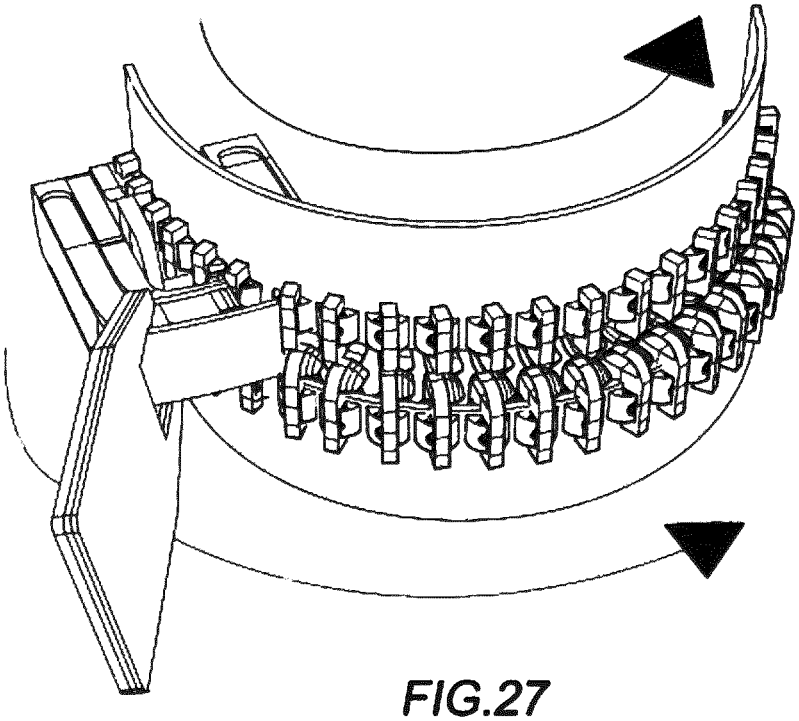
FIG. 27 represents a perspective view of the zip forming the subject of the present invention in accordance with the first embodiment and of the slider.

The practical utility of the present invention manifests itself precisely in the case of curvature of the slot of the article on which the zip is inserted (FIG. 27). The internal protrusions of the tooth, stressed by the action of the slider, automatically slide in the tracks of the half-cylinders, allowing a natural and optimal, resistant and aesthetically pleasing closure of the article.

Second Embodiment

With regard to the second embodiment of the present invention, shown in FIGS. 9 to 12 and 28 to 40, a tooth 12 goes to interlock with a particular support, constituted in this case by a cylinder 30.

Said cylinder 30 has a vertical slot 37 along the central axis, of different height and width according to needs, which traverses it from one end to the other and therefore for the entire length of the diameter of the lower base.

Figure 32:
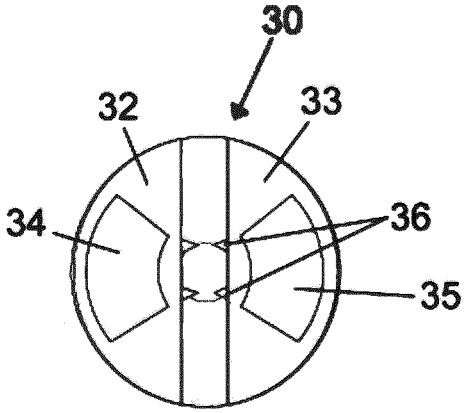
FIG. 32 represents a view from below of the support of a tooth in accordance with the second embodiment.
Figure 33:
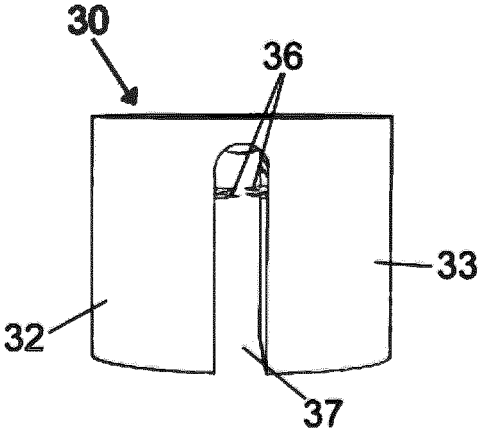
FIG. 33 represents a side view of the support of a tooth in accordance with the second embodiment.
Figure 34:
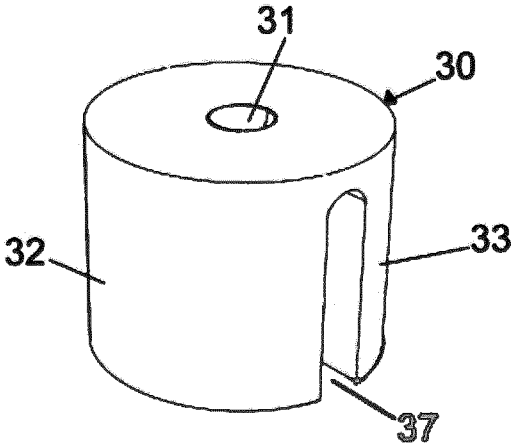
FIG. 34 represents a longitudinal perspective view of the support of a tooth in accordance with the second embodiment.
Figure 35:
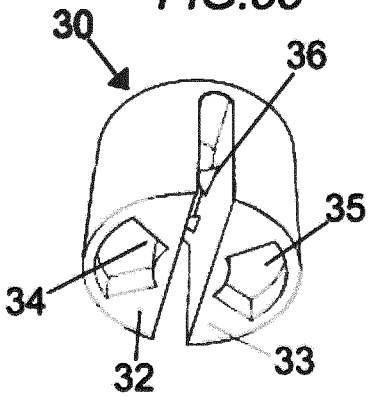
FIG. 35 represents a lower perspective view of the support of a tooth in accordance with the second embodiment.
Figure 36:
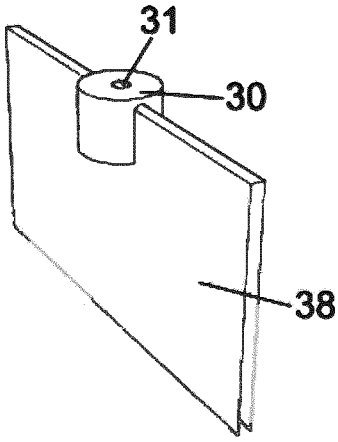
FIG. 36 represents a longitudinal perspective view of a tooth fixed to the webbing in accordance with the second embodiment.

The vertical slot 37 of the cylinder 30 divides the lower base of the support into two identical and specular lunettes 32 and 33, seen more clearly in FIG. 32 and in FIG. 35).

The edge of a webbing of fabric 38 is inserted into the aforementioned slot (FIG. 36), the walls of which have knurls 36 designed to inhibit the movement of the cylinder 30 on the fabric. Each cylinder is then firmly fixed to the fabric by means of compression.

Figure 37:
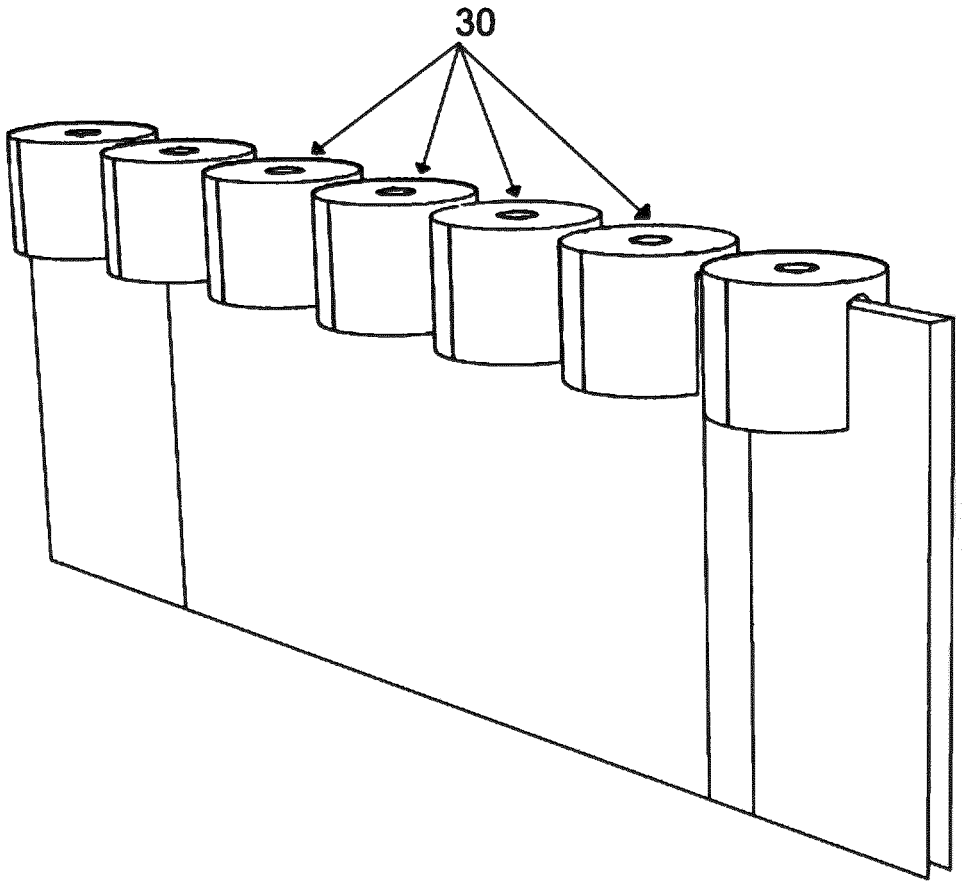
FIG. 37 represents a perspective view of the webbing with a series of supports of the tooth attached to the fabric in accordance with the second embodiment.
Figure 38:
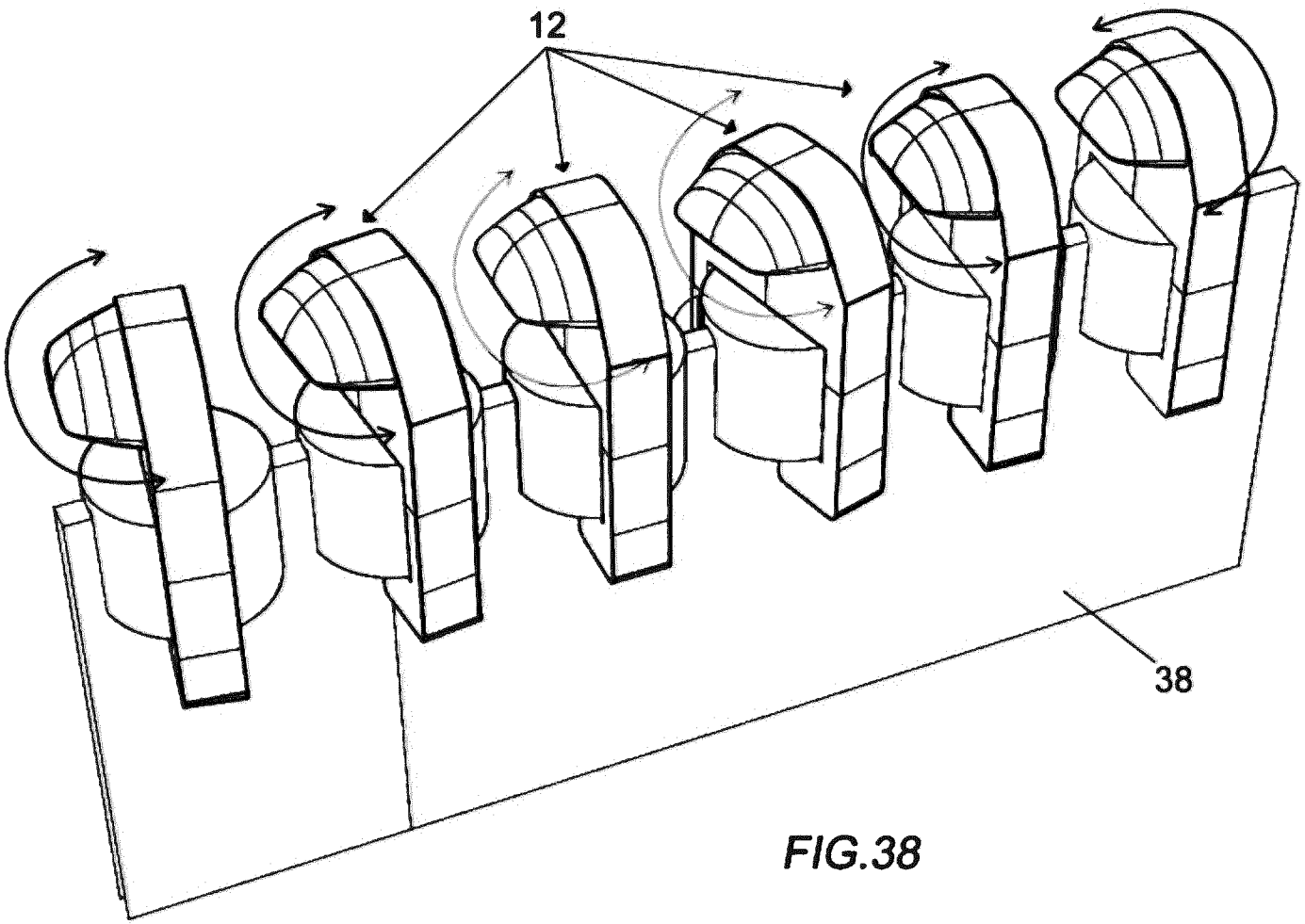
FIG. 38 represents a longitudinal view of the tape with a series of teeth forming the subject of the present invention in accordance with the second embodiment.
Figure 39:
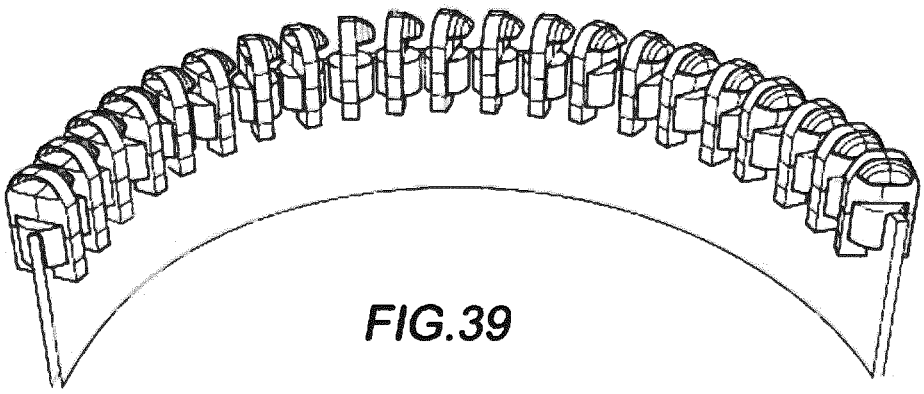
FIG. 39 represents a longitudinal perspective view of the tape with a series of teeth forming the subject of the present invention in accordance with the second embodiment.
Figure 40:
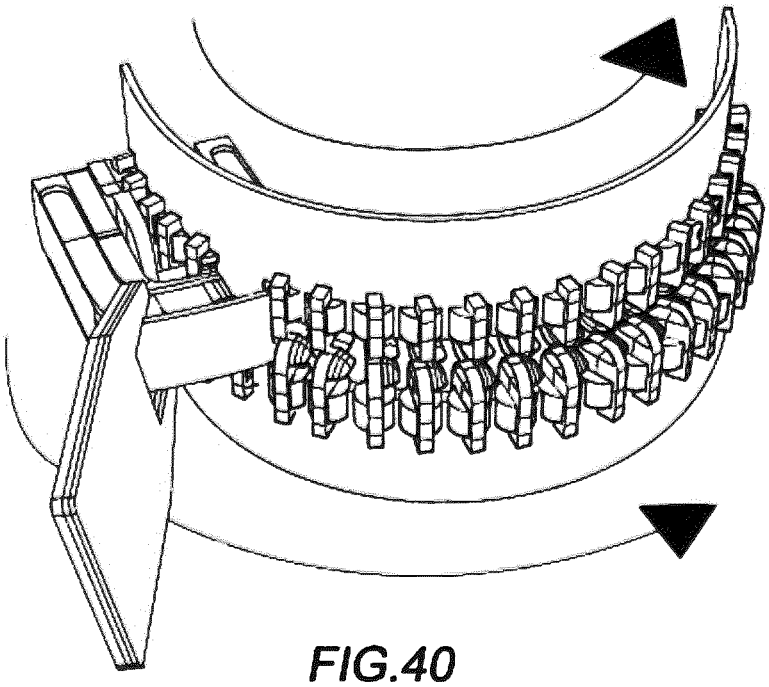
FIG. 40 represents a perspective view of the zip forming the subject of the present invention in accordance with the second embodiment and of the slider.

Similarly to the first embodiment of the present invention already described, these cylinders constitute the fixed point of the zip on the webbing and are mounted therein, generally but not necessarily, equidistant one from the other (FIG. 37).

Each cylinder is characterised in that it has, as lower base, the aforementioned lunettes 32 and 33 in which two identical tracks 34 and 35 are placed, perpendicular to the longitudinal plane of the cylinder.

Figure 31:
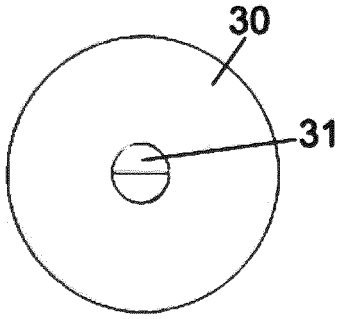
FIG. 31 represents a view from above of the support of a tooth in accordance with the second embodiment.

At the centre of the upper base of the aforementioned cylinder 30, a hole 31 is instead positioned, of any type of size and shape, and represented, merely by way of a non-limiting example, in ovoid form (FIG. 31).

Said hole has the main task of going to interlock in an upper internal protrusion 17 of the tooth 12, as will be explained here below.

The tooth 12 according to this embodiment, (FIG. 28), is characterised in that it has two L-shaped legs 13 and 14.

Three protrusions 15, 16 and 17 stand out in its inner central part, shown, by way of a non-limiting example, in ovoid form.

More particularly, two protrusions 15 and 16 are positioned in the horizontal part of the "L" of the legs of the tooth. The third protrusion 17 is instead positioned in front of these, under the head of the tooth 12, exactly at the centre of the horizontal line of the internal groove of the tooth itself.

As described above, the upper protrusion 17 goes to insert in the hole 31 of the upper base of the cylinder 30. The lower protrusions 15 and 16 instead go to insert in the respective tracks 34, 35 located on the lunettes of the lower base of the cylinder.

Figure 30:
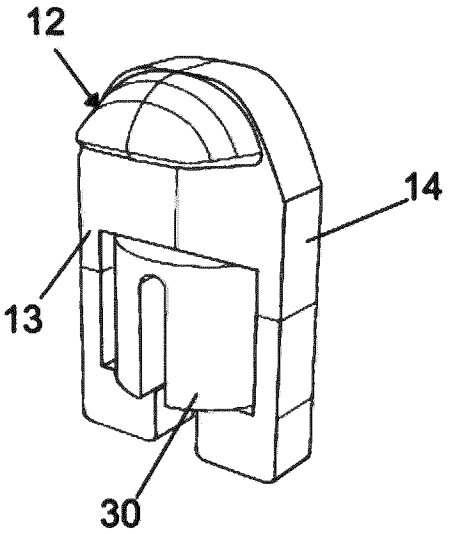
FIG. 30 represents a complete perspective view of a tooth forming the subject of the present invention in accordance with the second embodiment.
Figure 29:
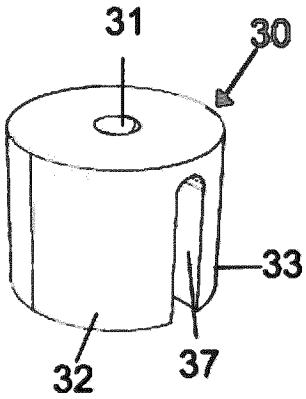
FIG. 29 represents a perspective view of the support of a tooth in accordance with the second embodiment.
Figure 28:
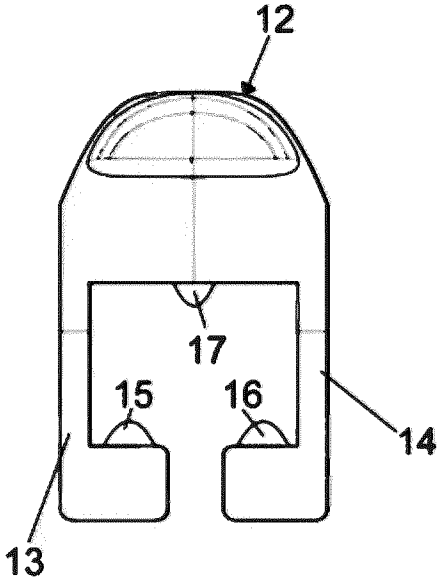
FIG. 28 represents a front view of a tooth in accordance with the second embodiment.

The final complete configuration of the tooth coupled to the relative support forming the subject of the present invention is shown in FIG. 30.

The mechanism of rotation of the tooth is intuitive: its lower protrusions slide, in one direction or in the other, along the tracks of the lower base of the cylinder and the rotation is therefore axial around the central vertical axis of the tooth.

Along this axis is the upper protrusion of the tooth which, inserting in the hole of the upper base of the support, holds the tooth in the pre-established position, preventing it from sliding to one side or to the other.

The subject of the present invention has, therefore, a part stably fixed to the webbing 38, i.e. the cylinder 30, and a movable and pivoting part, i.e. the tooth 12, which oscillates thanks to the sliding of the protrusions along the tracks of the support.

The chain of the zip forming the subject of the present invention is therefore constituted by a series of teeth with relative supports as described above (FIGS. 39 and 40).

The practical utility of the present invention is the same already described with reference to the first embodiment.

Naturally, the invention is not limited to the particular embodiments previously described and illustrated in the accompanying drawings, but numerous detailed changes may be made thereto, within the reach of the person skilled in the art, without thereby departing from the scope of the invention itself, defined by the appended claims.

The invention claimed is:

1. A zip comprising a pair of webbings (29; 38), each of which has on its side edges sequences of coupling elements (5; 12) facing with respect to their sector of joining with the webbing, each of these coupling elements (5; 12) being able to pivot around its central vertical axis thanks to a support, placed between the coupling element (5; 12) and the webbing (29; 38), wherein the coupling element (5; 12) engages with the support and the latter with the webbing (29; 38), characterized in that said support consists of a cylinder (30) or of two half-cylinders (18, 19) arranged in a specular manner at opposite sides of the webbing (38; 29).

2. The zip according to claim 1, characterized in that the aforementioned two half-cylinders (18, 19) have holes (27, 28) which traverse them from side to side and are firmly joined one to the other and to the webbing itself (29) by means of a pin (24) which, traversing the holes (27, 28) present in the two half-cylinders, pierces, in the middle, the fabric of the webbing.

3. The zip according to claim 1, characterized in that said two half-cylinders (18, 19) have two pairs of identical tracks (20, 21) and (22, 23) positioned on their horizontal planes, or upper and lower faces, perpendicular to the longitudinal plane of the two half-cylinders.

4. The zip according to claim 3, characterized in that said coupling elements (5) have a pair of legs with an L shape (6, 7) having, in their inner part, four protrusions (8, 9, 10, 11) apt to slide in the tracks of the abovementioned two half-cylinders (20, 21, 22, 23).

5. The zip according to claim 4, characterized in that it has two of the aforementioned protrusions (8, 9) positioned in the horizontal part of the "L" of each leg (6, 7) of the coupling element (5), while the other two protrusions (10, 11) are positioned in a specular manner in front of the latter, under the head of the coupling element.

6. The zip according to claim 3, characterized in that the protrusions positioned in the horizontal part of the legs (6, 7) of the coupling element (5) are inserted in the lower tracks (22, 23) of the two half-cylinders (18, 19), while the protrusions arranged in a specular manner (10, 11) are inserted in the upper tracks (20, 21) of the two half-cylinders (18, 19).

7. The zip according to claim 1, characterized in that said cylinder (30) has a vertical slot along the central axis (37), which traverses it for the entire length of the diameter of the lower base.

8. The zip according to claim 7, characterized in that the edge of the webbing (38) is inserted in the aforementioned slot (37), the walls of which have a knurling (36), and each cylinder (30) is firmly fixed to the fabric by means of compression.

9. The zip according to claim 7, characterized in that each cylinder (30) has, as lower base, two lunettes (32, 33) in which are placed two identical and specular tracks (34, 35), perpendicular to the longitudinal plane of the cylinder.

10. The zip according to claim 7, characterized in that each cylinder (30) has at the centre of the upper base a hole (31).

11. The zip according to claim 7, characterized in that said coupling elements (12) have a pair of legs in the shape of an "L" (13, 14) having, in their inner part, three protrusions (15, 16, 17) apt to slide in the tracks (34, 35) and in the hole (31) of the abovementioned cylinder (30).

12. The zip according to claim 11, characterized in that it has two of the aforementioned protrusions (15, 16) positioned in the horizontal part of the "L" of the leg (13, 14) of the coupling element (12) while the other protrusion (17) is positioned in front of the latter, under the head of the coupling element (12), exactly in the centre of the horizontal line of its internal groove.

13. The zip according to claim 7, characterized in that the lower protrusions (15, 16) of the coupling element (12) are inserted in the tracks (34, 35) of the cylinder, while the upper protrusion (17) of the coupling element (12) is inserted in the hole (31) present in the upper base of the cylinder itself (30).

* * * * *